US006341721B1

(12) United States Patent
Herald et al.

(10) Patent No.: US 6,341,721 B1
(45) Date of Patent: Jan. 29, 2002

(54) CONTAINER CLOSURE

(75) Inventors: Coy M. Herald, W. Lafayette; David E. Babcock, Lafayette, both of IN (US)

(73) Assignee: Alcoa Closure Systems International Inc., Crawfordsville, IN (US)

( * ) Notice: Subject to any disclaimer, the term of this patent is extended or adjusted under 35 U.S.C. 154(b) by 0 days.

(21) Appl. No.: 09/815,025

(22) Filed: Mar. 22, 2001

(51) Int. Cl.[7] ..... B65D 47/00
(52) U.S. Cl. ..... 222/548
(58) Field of Search ..... 222/153.14, 518, 222/548, 553, 484

(56) References Cited

U.S. PATENT DOCUMENTS

| | | | | |
|---|---|---|---|---|
| 2,210,206 | A | | 8/1940 | Fisher |
| 2,695,737 | A | | 11/1954 | Schlicksupp |
| 4,135,513 | A | | 1/1979 | Arisland |
| 4,314,656 | A | | 2/1982 | Kessler |
| 4,776,501 | A | | 10/1988 | Ostrowsky |
| 5,265,777 | A | | 11/1993 | Weinstein |
| 5,472,120 | A | | 12/1995 | Stebick et al. |
| 5,699,933 | A | | 12/1997 | Ho et al. |
| 5,799,839 | A | * | 9/1998 | Moran et al. ..... 222/484 |
| 5,850,908 | A | | 12/1998 | Jasek |
| 5,975,369 | A | | 11/1999 | Yurkewicz et al. |
| 6,213,351 | B1 | * | 4/2001 | Stoneberg et al. ..... 222/153.14 |
| 6,299,027 | B1 | * | 10/2001 | Berge et al. ..... 222/153.14 |

* cited by examiner

*Primary Examiner*—Philippe Derakshani
*Assistant Examiner*—Thach H. Bui
(74) *Attorney, Agent, or Firm*—Rockey, Milnamow & Katz Ltd.

(57) ABSTRACT

A self-sealing, dispensing closure comprises a shell, a cover moveable axially toward and away from the shell, and a valve connected to the cover via a stem, and adapted to close the outlet when the cover is moved away from the shell and to open the outlet when the cover is moved toward the shell. The shell has a generally conical surface. The cover has a resilient skirt, which is discontinuous. The skirt engages the surface to bias the cover away from the shell and to bias the valve toward the closing position but to permit the cover to move toward the shell and to permit the valve to move away from the closing position. The shell and the cover have formations coactive to prevent the cover from being moved toward the shell and the valve from being moved away from the closing position at certain but not all positions of relative rotation of the shell and the cover.

10 Claims, 4 Drawing Sheets

CONTAINER CLOSURE

FIELD OF THE INVENTION

This invention pertains to a self-sealing, dispensing closure of a type comprising a shell attachable to a container, a cover moveable toward and away from the shell, and a valve connected to the cover, via a stem extending through an outlet defined by the shell, so as to be conjointly moveable with the cover. When the outlet is closed by the valve, contents of the container cannot flow through the outlet, to a mouth defined by the cover. When the outlet is opened, contents can flow through the outlet, toward the mouth. This invention provides a novel mechanism to bias the valve so as to close the outlet without resort to a separate spring component or like element.

BACKGROUND OF THE INVENTION

So-called dispensing closures have found increasingly widespread applications on containers for water, fruit juices, isotonic "sport" drinks, and the like. Commonly, such a closure includes a manually operable valve arrangement, which permits the contents of the container to be dispensed as desired. In one common construction, a valve element is pulled outwardly, away from the container, for opening and is pushed inwardly for closing. As will be appreciated, a self-closing or self-sealing closure facilitates convenient use.

An early example of a generally similar closure of the type noted above is disclosed in U.S. Pat. No. 2,210,206 to Fisher; in this patent, a metal dome having spring legs is provided, which biases a valve so as to close an outlet. A later example of a generally similar closure is disclosed in U.S. Pat. No. 5,265,777 to Weinstein; in this patent, metal spring members of different configurations are provided, which in each instance bias a valve so as to close an outlet.

A closure of related interest is disclosed in U.S. Pat. No. 4,776,501 to Ostrowsky; in this patent spring members are formed unitarily on a polymeric component of a closure. Other closures of related interest are disclosed in U.S. Pat. No. 4,314,656 to Kessler, U.S. Pat. No. 5,472,120 to Stebick et al., and U.S. Pat. No. 5,975,369 to Yurkewicz et al.

SUMMARY OF THE INVENTION

This invention provides a self-sealing, dispensing closure for a container, which may contain water, a fruit juice, a an isotonic "sports" drink, or any of a wide variety of other potable or non-potable liquids, either carbonated or non-carbonated, or which may contain any of a wide variety of other fluent contents. The present closure comprises a shell attachable to the container, a cover moveable toward and away from the shell, and a valve connected to the cover, via a stem, so as to be conjointly moveable with the cover. Preferably, the shell, the cover, and the valve including the stem are molded from a polymeric material, such as polypropylene, and are assembled to provide the closure. Notably, the present inclosure includes a unitary spring arrangement, which provides for self-sealing without resort to a separate spring arrangement or like element.

The shell defines an outlet, through which the stem extends, and the cover defines a mouth. The valve is adapted to close the outlet, so as to prevent communication between the outlet and the mouth, when the cover is moved away from the shell sufficiently to move the valve to a closing position. The valve is adapted to open the outlet, so as to permit communication between the outlet and the mouth, when the cover is moved sufficiently toward the shell to move the valve from the closing position.

According to this invention, the shell has a biasing surface, which converges toward the line of movement. Notably, the cover has a resilient skirt, which engages the biasing surface so as to bias the cover away from the shell and so as to bias the valve toward the closing position. The resilient skirt permits the cover to move toward the shell and the valve to move away from the closing position. Advantageously, therefore, no separate metal or other spring members are required. Preferably, the biasing surface is an external surface, which is a surface of revolution, such as a conical surface or another converging or diverging surface. Preferably, the biasing surface converges toward the line of movement, away from the outlet, toward the cover.

In a preferred embodiment, the closure defines an axis, along which the cover is moveable toward and away from the shell and along which the valve is moveable conjointly with the cover, with the stem extending axially through the outlet. The shell has a generally conical surface, which is the biasing surface and which is coaxial with the axis defined by the closure. The cover has a resilient skirt, which is coaxial therewith and which engages the generally conical surface so as to bias the cover away from the shell and so as to bias the valve toward the closing position but so as to permit the cover to move toward the shell and so as to permit the valve to move away from the closing position. In the preferred embodiment, the generally conical surface of the shell is an external surface, which is continuous around the axis defined by the closure, but the resilient skirt is discontinuous therearound and comprises plural segments.

This invention provides a locking arrangement that prevents opening of the closure unless the cover is positioned in a predetermined orientation relative to the shell. Specifically, if the shell and the cover are arranged to permit relative rotation of the shell and the cover about the axis defined by the closure, the shell and the cover may have formations coactive to prevent the cover from being moved toward the shell and, thus, to prevent the valve from being moved away from the closing position at certain, but not all, positions of relative rotation of the shell and the cover. Those formations may comprise an annular array of spaced teeth, which are provided on the shell, and an annular array of spaced teeth, which are provided on the cover, which engage the teeth provided on the shell in those positions wherein the cover is prevented from moving toward the shell and the valve is prevented from moving away from the closing position. However, the teeth provided on the cover fit between the teeth provided on the shell so as to permit opening, when the cover and the shell are positioned otherwise.

The teeth provided on the cover may engage the teeth provided on the shell, in interference fits, in those positions wherein the cover is prevented from moving toward the shell and the valve is prevented from moving away from the closing position. Such interfering engagement between the teeth provided on the cover and the teeth provided on the shell acts to urge the valve into self-sealing engagement with a valve seat, in the closing position.

DETAILED DESCRIPTION OF THE PREFERRED EMBODIMENT

Figure 1:
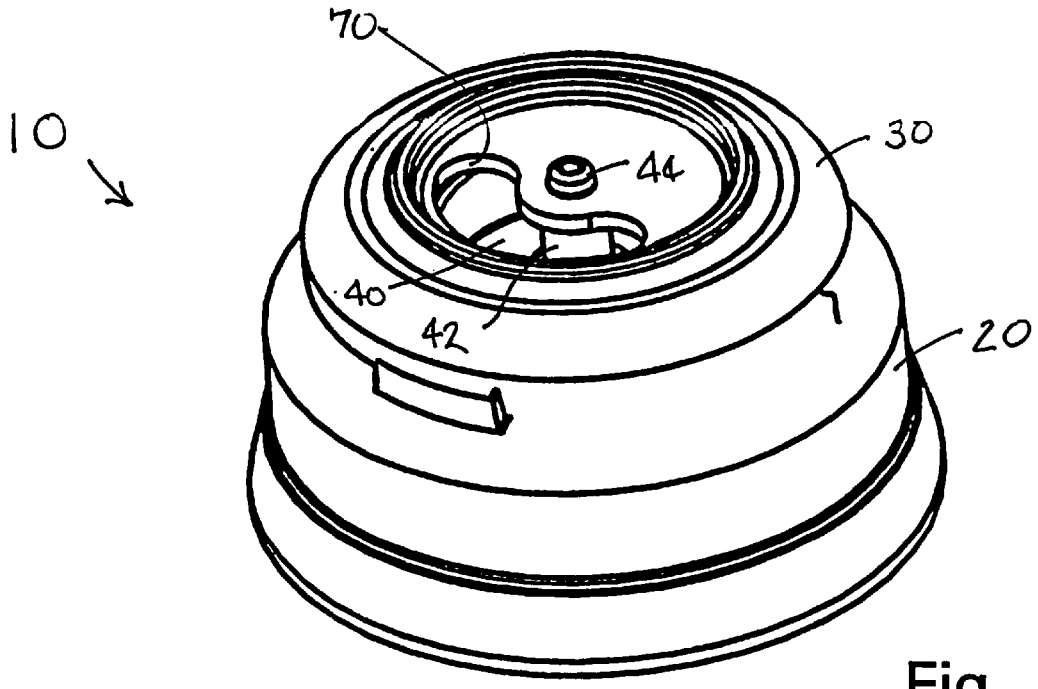
FIG. 1 is a perspective view of a closure defining an axis, comprising a shell, a cover, and a valve, as described above, and constituting a preferred embodiment of this invention.

While the present invention is susceptible of embodiment in different forms, there is shown in the drawings and will hereinafter be described a presently preferred embodiment with the understanding that the present disclosure is to be considered an exemplification of the invention and is not intended to limit the invention to the specific embodiment illustrated.

Figure 2:
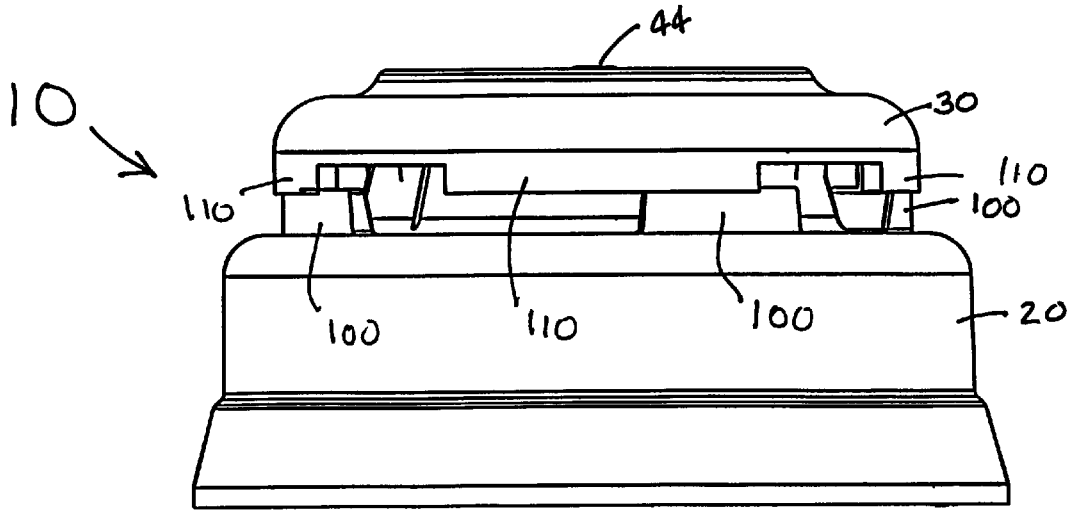
FIG. 2 is an elevation of the closure, as seen from one side.
Figure 3:
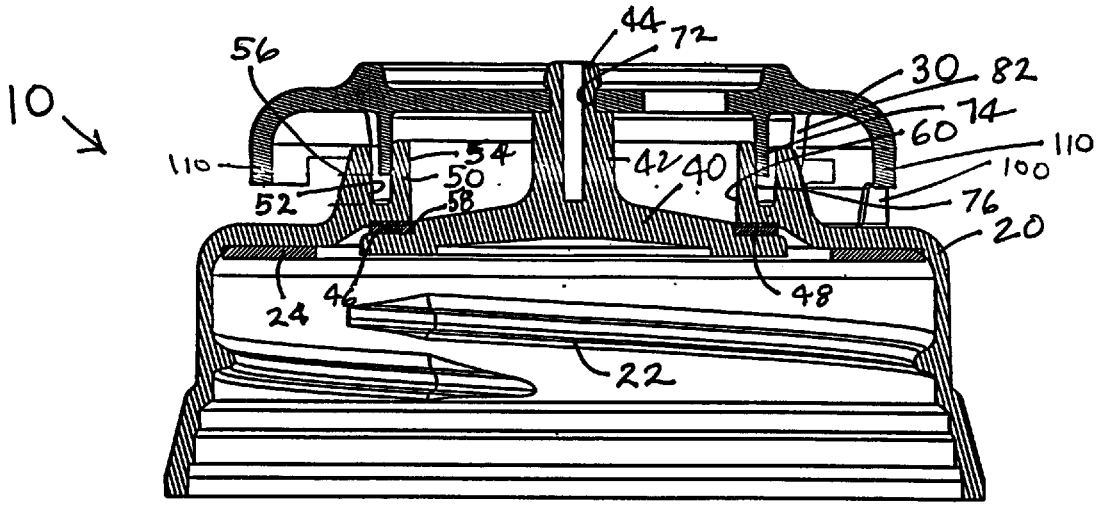
FIG. 3 is a cross-sectional view of the closure, as taken along a diametrical plane.
Figure 4:
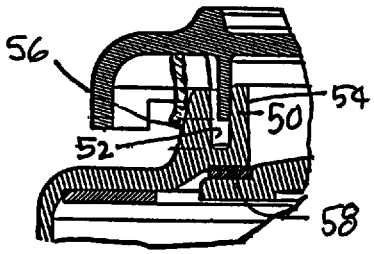
FIG. 4 is a fragmentary, cross-sectional detail of the closure, as shown in FIG. 3 except that the closure has been rotated slightly about its axis.
Figure 5:
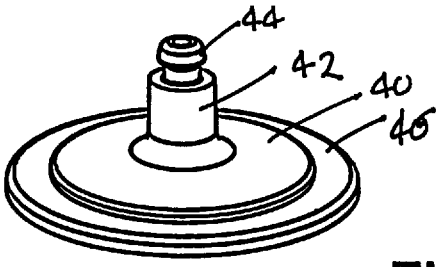
FIG. 5 is a perspective view of the valve, as seen from an upper vantage.
Figure 6:
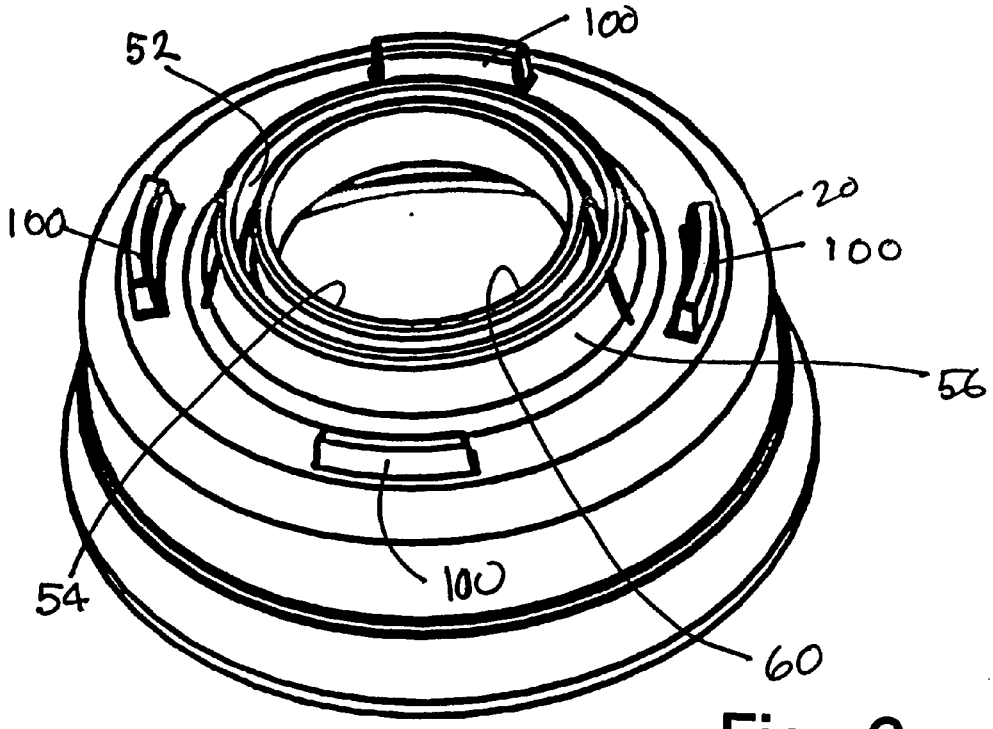
FIG. 6 is a perspective view of the shell, as seen from an upper vantage.
Figure 7:
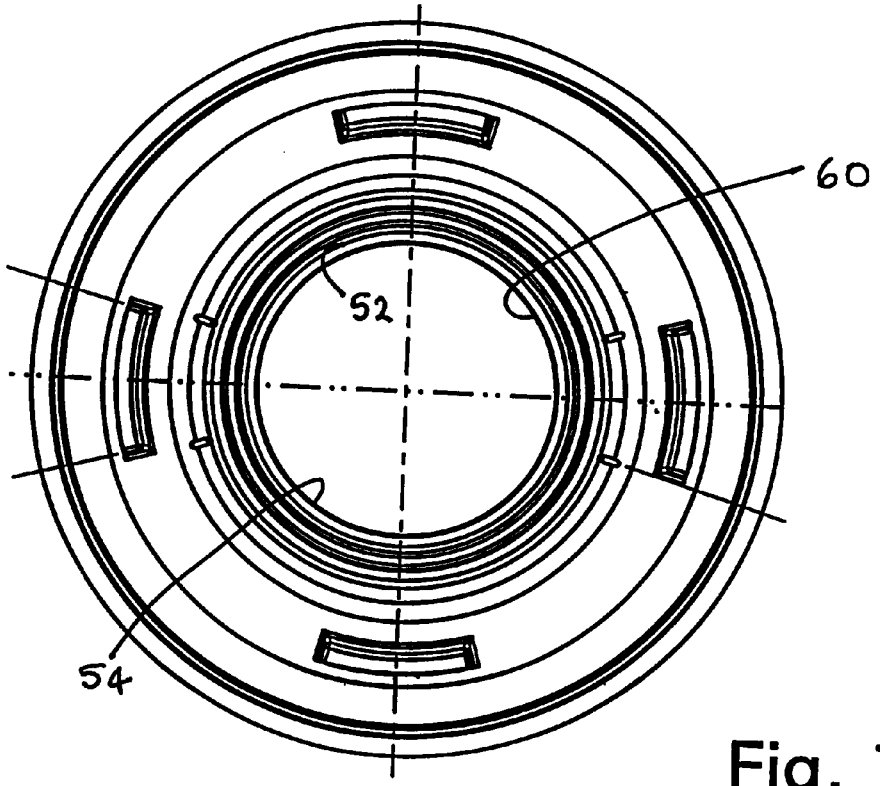
FIG. 7 is an upper plan of the shell.
Figure 8:
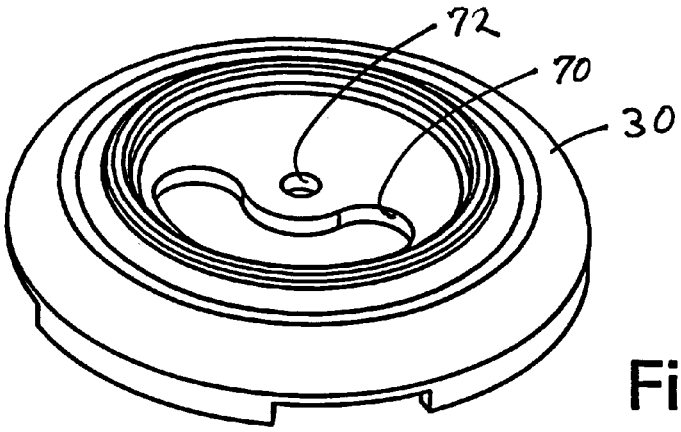
FIG. 8 is a perspective view of the cover, as seen from an upper vantage.
Figure 9:
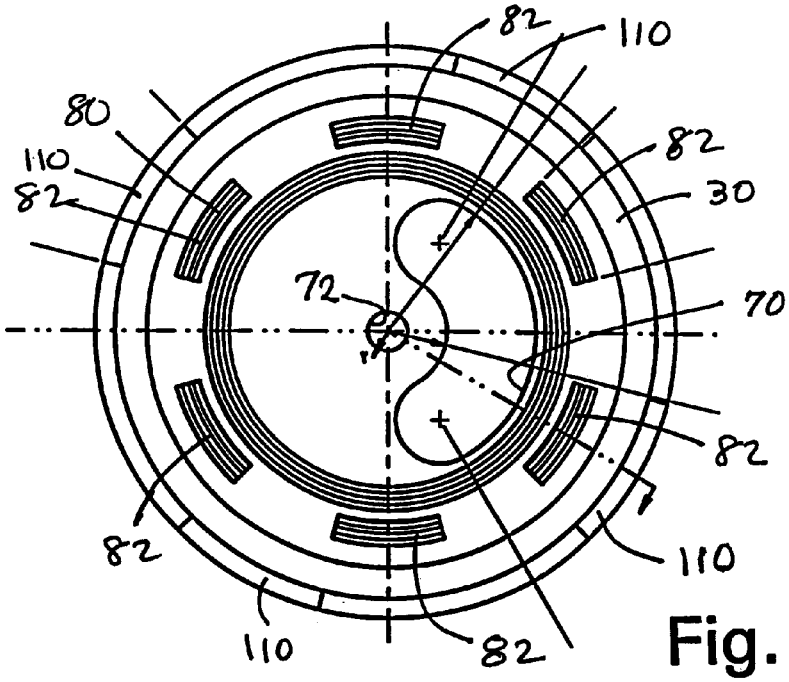
FIG. 9 is an upper plan of the cover.
Figure 10:
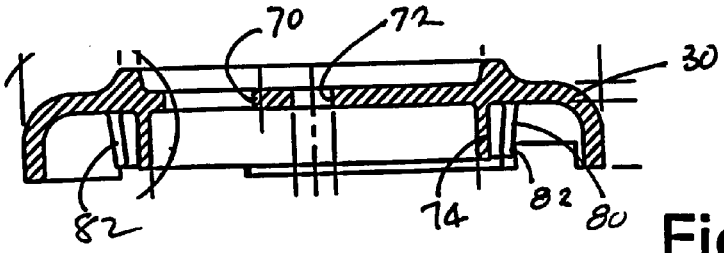
FIG. 10 is a cross-sectional view of the cover, as taken along a diametrical plane.

In FIGS. 1, 2, and 3, a self-sealing, dispensing closure 10 is shown, which defines an axis and which comprises a shell 20, a cover 30, and a valve 40, as a preferred embodiment of this invention. The shell 20, the cover 30, and the valve 40 are molded from a polymeric material, such as polypropylene, and are assembled to provide the closure 10. The closure 10 is designed for a container (not shown) which may contain water, a fruit juice, an isotonic "sports" drink, or any of a wide variety of other potable or non-potable liquids, either carbonated or non-carbonated, or which may contain any of a wide variety of other fluent contents. The closure 10 is suited particularly for a so-called "hot fill" beverage, which is introduced into the associated container at an elevated temperature, whereby a partial vacuum is created within the container-closure package upon cooling.

As shown in FIGS. 3, 4, 6, and 7, the shell 20 has an internal thread 22, which is adapted to coact with a external thread on a neck of such a container, whereby the shell 20 is attachable to the container. Rather than the internal thread 22, the shell 20 may have internal formations (not shown) enabling the shell 20 to be snap-fitted onto a neck of such a container or may be otherwise attachable to such a container. As shown in FIG. 3, the shell 20 mounts an optional, annular seal 24, which is made of a polymeric material suitable for such a seal and which is adapted to be axially compressed between the shell 20 and the neck of such a container, when the shell 20 is attached. The seal 24 may be a separate element, which is fitted to the container-closure package, or may be integrally formed with the shell 20, as by co-extrusion molding.

The shell 20 has an annular rib 50, which is coaxial with the axis defined by the closure 10 and which has an annular groove 52, an inner, cylindrical surface 54, an outer, generally frusto-conical surface 56, and an annular sealing surface 58 facing away from the annular groove 52. When the closure 10 is attached to such a container, the annular groove 52 opens away from the container and the inner, cylindrical surface 54 defines an outlet 60, through which contents of the container are dispensable when the outlet 60 is opened. Moreover, the outer, frusto-conical surface 56 converges away from the container, toward the axis defined by the closure 10, and the annular sealing surface 58 faces the container.

The cover 30 defines a mouth 70, which in the illustrated embodiment is spaced radially from the axis defined by the closure 10 and is shaped so as to permit a user to drink liquid contents dispensed through the outlet 60, when the outlet 60 is opened. Alternatively, the cover 30 may have an upstanding spout or mouth piece (not shown) defining such a mouth, which spout or mouth piece may be axially aligned or offset from the closure axis, and which spout or mouth piece may be unitarily molded or separately molded and integrally attached. The cover 30 has a stem-receiving aperture 72, which is centered at the axis defined by the closure 10. The cover 30 has an annular sealing fin 74, which fits into the annular groove 52 of the annular rib 50 of the shell 20 so as to bear snugly against an inner wall 76 of-the annular groove 52, so as to seal against leakage between the shell 20 and the cover 30, and so as to guide axial movement of the cover 30 toward and away from the shell 20.

The valve 40, which is generally disc-shaped, is connected to the cover 30, via a tubular stem 42 extending axially through the outlet 60 and having a distal end 44, which is adapted to be snap-fittable into the stem-receiving aperture 72 of the cover 30. The valve 40 and the tubular stem 42 are molded unitarily. The distal end 44 of the tubular stem 42 is snap-fitted into the stem-fitting aperture 72 of the cover 30 and may be permanently bonded, as by ultrasonic bonding or by solvent bonding, to the cover 30. Thus, the valve 40 is moveable conjointly with the cover 30, along the axis defined by the closure 10. As shown in FIG. 3, the valve 40 has an annular sealing surface 46, to which an annular seal 48 may be affixed. The annular seal 48, which is made of a polymeric material suitable for such a seal, conforms generally to the annular sealing surface 58 of the shell 20. The annular sealing surface 58 serves as a valve seat. Rather than being affixed to the valve 40, the annular seal 48 may be alternatively affixed to the annular sealing surface 58 of the shell 20.

The valve 40 is adapted to close the outlet 60, so as to prevent communication between the outlet 60 and the mouth 70, when the cover 30 is moved axially away from the shell 20 sufficiently to move the valve 40 to a closing position. When the valve 40 is moved to the sealing position, the annular seal 48 being compressed axially between the annular sealing surface 46 of the valve 40 and the annular sealing surface 58 of the shell 20. The valve 40 is adapted to open the outlet 60, so as to permit communication between the outlet 60 and the mouth 70, when the cover 30 is moved axially toward the shell 20 to move the valve 40 from the closing position toward a limiting positions in which the cover 30 bears against the shell 20 so as not to be further moveable toward the shell 20.

Notably, the cover 30 has a resilient skirt 80, which is coaxial with the axis defined by the closure 10. Being discontinuous in the presently preferred, illustrated embodiment, the resilient skirt 80 comprises plural segments 82, each engaging the frusto-conical surface 56 of the annular rib 50 of the shell 20. Being resilient, these segments 82 wipe against the frusto-conical surface 50 and are flexed outwardly so as to bias the cover 30 away from the shell 20 and so as to bias valve 40 toward the closing position, but so as to permit the cover 30 to move toward the shell 20 and so as to permit the valve 40 to move away from the closing position. Advantageously, therefore, no separate metal or other spring members are required. Presently, it is contemplated for the resilient skirt 80 to be configured to create a spring force on the order of five pounds, in opposition to movement of the cover 30 for opening of the closure 10.

As shown, the shell 20 and the cover 30 are arranged to permit relative rotation of the shell 20 and the cover 30 about the axis defined by the closure 10, the valve 40 being rotatable with the cover 30. The shell 20 has an annular array of spaced teeth 100. The cover 30 has an annular array of spaced teeth 110, which engage the shell teeth 100 in certain positions of relative rotation, so as to prevent the cover 30 from moving toward the shell 20 and so as to prevent the valve 40 from moving away from the closing position, but which fit between the shell teeth 100 otherwise. Such engaging teeth 100, 110, resist axial top-loading of a container-closure package including the closure 10, as in shipping and handling.

Preferably, in those positions of relative rotation, the cover teeth 110 engage the shell teeth 100 in interference fits, so as to prevent unintended rotation of the cover 30 relative to the shell 20. Such interfering engagement acts to urge the valve 40 into sealing engagement with the annular sealing surface 58 of the shell 20. Sealing is thus desirably enhanced.

Such enhanced sealing can be particularly desirable when a closure embodying this invention is used on a container for a "hot fill" beverage, since the closure can be configured to provide necessary sealing even under a partial vacuum, which can exist within the container after cooling. In such an arrangement, the biasing force created by the resilient skirt needs only to be sufficient to seal against leakage after disengagement of the interfering teeth on the shell of the closure and the cover of the closure. Easier opening, by virtue of a relatively lesser sealing spring force is thus facilitated. As will be appreciated, a closure embodying this invention may be configured for use on a container for a carbonated beverage, which creates gas pressure within the container. Since gas pressure within the container urges the valve of the closure to its closed position, a relatively lower biasing force from the resilient skirt of the closure can suffice.

Figure 11:
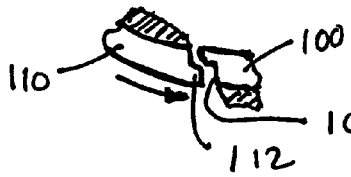
FIG. 11 is a fragmentary, perspective detail of two coactive teeth on the shell and on the cover respectively.

Optionally, the closure 10 may include an arrangement for retaining the cover 30 in its open position relative to the shell 20, in opposition to the biasing force provided by the resilient skirt 80. As shown in FIG. 11, in which one of the shell teeth 100 and one of the cover teeth 110 are shown fragmentarily, each of the shell teeth 100 may have a circumferentially extending recess 102 and each of the cover teeth 110 may have a circumferentially extending lug 112, which is adapted to fit into the circumferentially extending recess 102 of one of the shell teeth 100, upon slight rotation of the cover 30 relative to the shell 20 after the cover 30 has been pressed axially toward the cover so as to move the valve 40 from the closing position and so as to open the outlet 60, whereby to interlock the shell 20 and the cover 30 releasably.

Optionally, the valve 40 may have a sharpened formation (not shown) facing the container, which sharpened formation is useful to puncture a foil seal (not shown) provided on the neck of the container, when the cover 30 has been pressed axially toward the cover so as to move the valve 40 from the closing position.

From the foregoing, it will be observed that numerous variations and modifications may be effected without departing from the true spirit and scope of the novel concept of the present invention. It will be understood that no limitations with respect to the specific embodiment illustrated herein is intended or should be inferred. It is, of course, intended to cover by the appended claims all such modifications that fall within the scope of the claims.

What is claimed is:

1. For a container, a closure defining an axis and comprising a shell attachable to the container, the shell defining an outlet, a cover moveable toward and away from the shell, along the axis defined by the closure, the cover defining a mouth, and a valve connected to the cover, via a stem extending axially through the outlet, so as to be conjointly moveable with the cover, along the axis defined by the closure, the valve being adapted to close the outlet, so as to prevent communication between the outlet and the mouth, when the cover is moved away from the shell sufficiently to move the valve to a closing position, the valve being adapted to open the outlet, so as to permit communication between the outlet and the mouth, when the cover is moved sufficiently toward the shell to move the valve from the closing position, the shell having a generally conical surface, which is coaxial with the axis defined by the closure, the cover having a resilient skirt, which is coaxial with the axis defined by the closure, the resilient skirt engaging the generally conical surface so as to bias the cover away from the shell and so as to bias the valve toward the closing position, but so as to permit the cover to move toward the shell and so as to permit the valve to move away from the closing position.

2. The closure of claim 1 wherein the shell and the cover are arranged to permit relative rotation of the shell and the cover about the axis defined by the closure, the valve being rotatable with the cover, and wherein the shell and the cover have formations coactive to prevent the cover from being moved toward the shell and the valve from being moved away from the closing position at certain, but not all, positions of relative rotation of the shell and the cover.

3. The closure of claim 2 wherein said formations comprise an annular array of spaced teeth, which are provided on the shell, and an annular array of spaced teeth, which are provided on the cover, which engage the teeth provided on the shell in those positions wherein the cover is prevented from moving toward the shell and the valve is prevented from moving away from the closing position, but which fit between the teeth provided on the shell otherwise.

4. The closure of claim 2 wherein said formations comprise an annular array of spaced teeth, which are provided on the shell, and an annular array of spaced teeth, which are provided on the cover, which engage the teeth provided on the shell, in interference fits, in those positions wherein the cover is prevented from moving toward the shell and the valve is prevented from moving away from the closing position, but which fit between the teeth provided on the shell otherwise.

5. The closure of claim 1 wherein the generally conical surface of the shell is continuous around the axis defined by the closure but wherein the resilient skirt is discontinuous around the axis defined by the closure and comprises plural segments.

6. The closure of claim 5 wherein the generally conical surface is an external surface.

7. For a container, a closure comprising a shell attachable to the container, the shell defining an outlet, a cover moveable toward and away from the shell, the cover defining a mouth, and a valve connected to the cover, via a stem extending through the outlet, so as to be conjointly moveable with the cover, along a line of movement, the valve being adapted to close the outlet, so as to prevent communication between the outlet and the mouth, when the cover is moved away from the shell sufficiently to move the valve to a closing position, the valve being adapted to open the outlet, so as to permit communication between the outlet and the mouth, when the cover is moved sufficiently toward the shell to move the valve from the closing position, the shell having a biasing surface converging toward the line of movement, the cover having a resilient skirt, the resilient skirt engaging the biasing surface so as to bias the cover away from the shell and so as to bias the valve toward the closing position but so as to permit the cover to move toward the shell and so as to permit the valve to move away from the closing position.

8. The closure of claim 7 wherein the biasing surface is a surface of revolution and converges toward the line of movement.

9. The closure of claim 7 wherein the biasing surface is an external surface, which converges away from the outlet, toward the cover.

10. The closure of claim 9 wherein the biasing surface is an external surface, which converges away from the outlet, toward the cover.

* * * * *